US008534538B2

(12) United States Patent
Fitzwater

(10) Patent No.: US 8,534,538 B2
(45) Date of Patent: Sep. 17, 2013

(54) CARTON WITH PRODUCT HOLDING COMPARTMENTS

(75) Inventor: Kelly R. Fitzwater, Lakewood, CO (US)

(73) Assignee: Graphic Packaging International, Inc., Marietta, GA (US)

( * ) Notice: Subject to any disclaimer, the term of this patent is extended or adjusted under 35 U.S.C. 154(b) by 432 days.

(21) Appl. No.: 12/836,639

(22) Filed: Jul. 15, 2010

(65) Prior Publication Data

US 2011/0011923 A1 Jan. 20, 2011

Related U.S. Application Data

(60) Provisional application No. 61/270,923, filed on Jul. 15, 2009.

(51) Int. Cl.
*B65D 25/04* (2006.01)
*B65D 5/00* (2006.01)
*B31B 3/00* (2006.01)

(52) U.S. Cl.
USPC ..... 229/120.08; 493/162; 428/12

(58) Field of Classification Search
USPC ..... 229/120.08, 402, 120.02, 121, 120.24, 229/120.11, 120.31, 120.05, 120.09; 206/774, 206/749, 750, 751, 752, 755
See application file for complete search history.

(56) References Cited

U.S. PATENT DOCUMENTS

| | | | | |
|---|---|---|---|---|
| 732,844 | A * | 7/1903 | Gerbereux | 229/120.09 |
| 1,662,028 | A * | 3/1928 | Gold et al. | 206/256 |
| 1,824,491 | A * | 9/1931 | Molins | 206/273 |
| 1,883,852 | A * | 10/1932 | Medoff | 206/449 |
| 2,162,094 | A * | 6/1939 | Mahone | 229/120.09 |
| 5,123,589 | A * | 6/1992 | Cote | 229/232 |
| 6,102,197 | A | 8/2000 | Negelen | |
| 7,159,717 | B2 | 1/2007 | Aldridge et al. | |
| D540,668 | S | 4/2007 | Aldridge | |
| 7,476,830 | B2 | 1/2009 | Middleton et al. | |
| 7,569,008 | B2 | 8/2009 | Aldridge et al. | |
| 7,617,969 | B2 | 11/2009 | Oliveira | |
| 7,686,165 | B2 | 3/2010 | Aldridge et al. | |
| 7,793,780 | B2 | 9/2010 | Smalley | |
| 2001/0030228 | A1 | 10/2001 | Todjar-Hengami | |
| 2008/0197178 | A1 * | 8/2008 | Aldridge et al. | 229/120.08 |
| 2008/0264812 | A1 | 10/2008 | Gonzalez | |

FOREIGN PATENT DOCUMENTS

| | | | |
|---|---|---|---|
| KR | 20-0115382 | Y1 | 4/1998 |
| KR | 10-0336431 | B1 | 5/2002 |
| KR | 10-0856067 | B1 | 9/2008 |

OTHER PUBLICATIONS

International Search Report and Written Opinion for PCT/US2010/042042, dated Feb. 17, 2011.

* cited by examiner

*Primary Examiner* — Gary Elkins
*Assistant Examiner* — Christopher Demeree
(74) *Attorney, Agent, or Firm* — Womble Carlyle Sandridge & Rice, LLP

(57) ABSTRACT

A carton for containing a product. The carton comprises a back panel, a front panel, a bottom panel, and a top flap. A first compartment is foldably connected to the back panel, and a second compartment is foldably connected to the front panel. The top flap is operable to overlap the first and second compartments of the carton.

47 Claims, 13 Drawing Sheets

CARTON WITH PRODUCT HOLDING COMPARTMENTS

CROSS-REFERENCE TO RELATED APPLICATIONS

This application claims the benefit of U.S. Provisional Patent Application No. 61/270,923, filed Jul. 15, 2009.

INCORPORATION BY REFERENCE

U.S. Provisional Patent Application No. 61/270,923, which was filed on Jul. 15, 2009, is hereby incorporated by reference for all purposes as if presented herein in its entirety.

BACKGROUND OF THE DISCLOSURE

The present disclosure generally relates to cartons for holding products, and more particularly, to a carton having multiple compartments.

SUMMARY OF THE DISCLOSURE

In general, one aspect of the disclosure is directed to a carton for containing at least one product. The carton comprises a back panel, a front panel, a bottom panel, and a top flap. A first compartment is foldably connected to the back panel, and a second compartment is foldably connected to the front panel. The top flap is operable to overlap the first and second compartments of the carton.

In another aspect, the disclosure is generally directed to a blank for forming a carton for containing at least one product. The blank comprises a back panel, a front panel, a bottom panel, and a top flap. A first compartment flap is foldably connected to the back panel, and a second compartment flap is foldably connected to the front panel. The top flap is for overlapping a first compartment formed from the first compartment flap and a second compartment formed from the second compartment flap when the blank is formed into the carton.

In another aspect, the disclosure is generally directed to a method for forming a carton for containing at least one product. The method comprises obtaining a blank comprising a back panel, a front panel, a bottom panel, a top flap, a first compartment flap foldably connected to the back panel, and a second compartment flap foldably connected to the front panel. The method further comprises forming a first compartment by folding the first compartment flap with respect to the back panel, forming a second compartment by folding the second compartment flap with respect to the front panel, and at least partially closing the carton by folding the top flap to at least partially overlap the first and second compartments.

Other aspects, features, and details of the present disclosure can be more completely understood by reference to the following detailed description of exemplary embodiments taken in conjunction with the drawings and from the appended claims.

The various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to a carton or package that is used to hold various products, such as any suitable consumer product that is suitable for holding in a carton or package for quick access and use. Such products can include women's incontinence products, make-up, diaper wipes, or any other suitable product. Also, food products can be held in the carton such as snacks for infants, toddlers, children, or adults, or any other suitable food product. Further, pet treats such as dog or cat treats, or any other suitable product, can be held in the carton.

Figure 1:
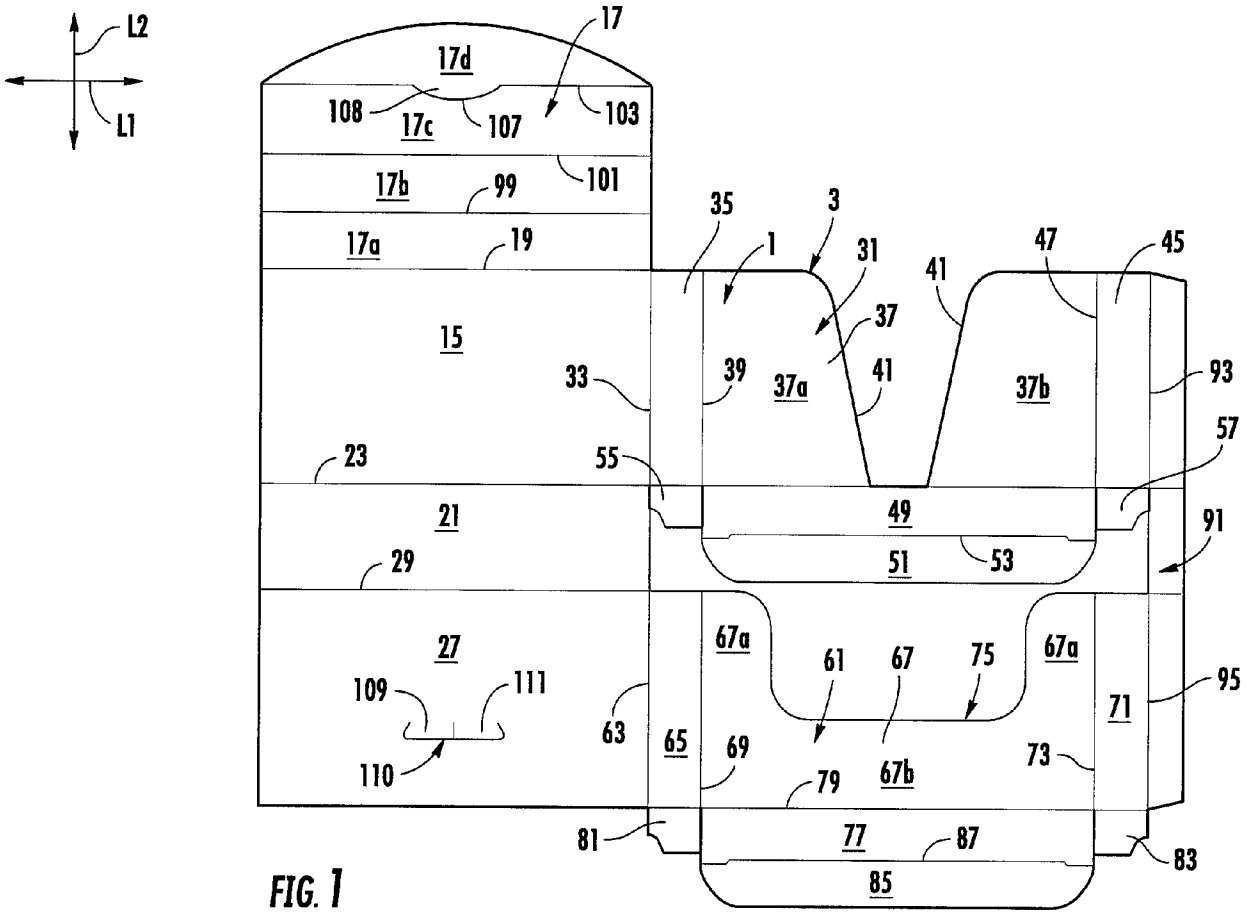
FIG. 1 is a plan view of an exterior of a carton blank for forming a carton according to one embodiment of the disclosure.
Figure 3:
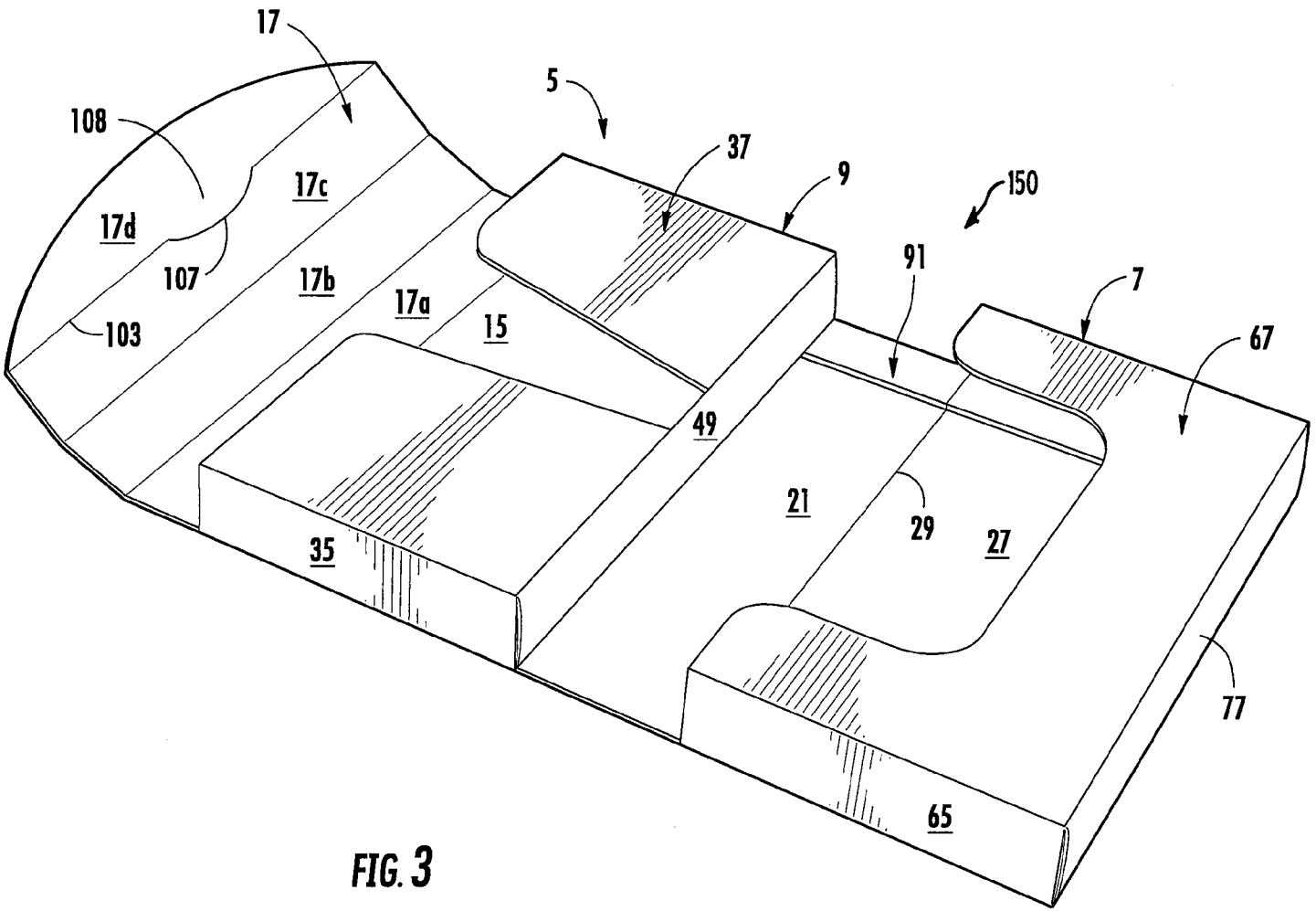
FIG. 3 is a perspective view of a carton in an open configuration according to one embodiment of the disclosure.
Figure 6:
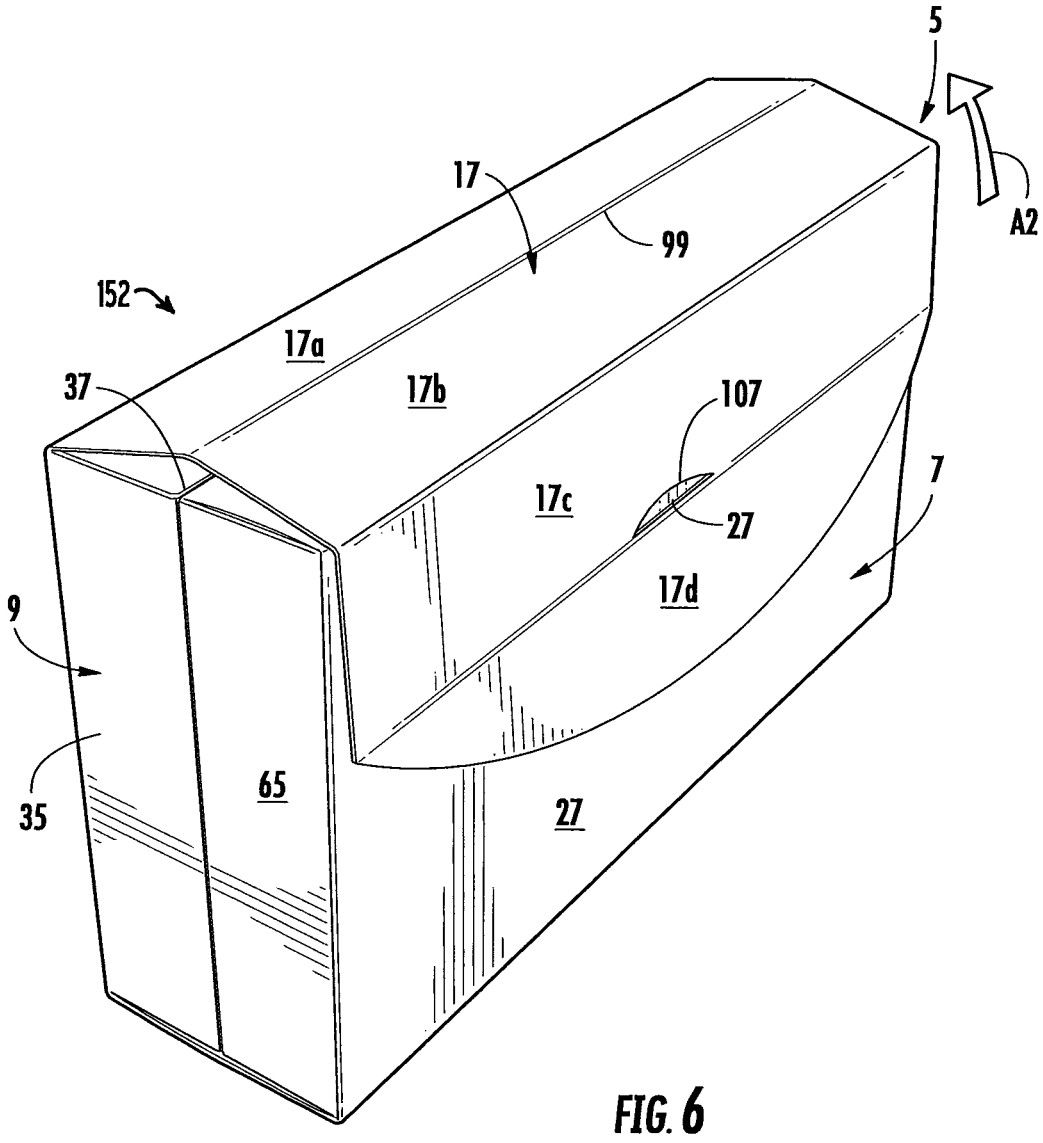

FIG. 1 is a plan view of the exterior side 1 of a blank, generally indicated at 3, used to form a carton 5 (FIGS. 3 and 6) according to a first exemplary embodiment of the disclosure. In the illustrated embodiment, the carton 5 has a front compartment 7 and a rear compartment 9. Each of the compartments 7, 9 are capable of holding a product in an isolated compartment that is separated from the product in the other compartment. The front compartment 7 and the rear compartment 9 are positioned in generally side-by-side inverted relationship in a closed configuration of the carton 5 (FIG. 6). The front compartment 7 and rear compartment 9 can be otherwise shaped, arranged, and/or positioned without departing from the disclosure. According to an exemplary embodiment of the disclosure, the carton 5 can be formed from a unitary, one-piece blank 3, as shown in FIG. 1.

The blank 3 includes a longitudinal axis L1 that extends generally in the direction of the length of the blank and a lateral axis L2 that extends generally in the direction of the width of the blank. The blank 3 has a back panel 15, a top flap 17 foldably connected to the back panel at a longitudinal fold line 19, and a bottom panel 21 foldably connected to the back panel 15 at a longitudinal fold line 23. A front panel 27 is foldably connected to the bottom panel 21 at a longitudinal fold line 29.

In the embodiment of FIG. 1, a first (back) compartment flap 31 is foldably connected to the back panel 15 at a lateral fold line 33. The first compartment flap 31 comprises a first side panel 35, a compartment panel 37 foldably connected to the side panel 35 at a lateral fold line 39. The compartment panel 37 includes oblique edges 41 that divide the compartment panel into first and second retaining portions 37*a*, 37*b*. A second side panel 45 is foldably connected to the second portion 37*b* of the compartment panel 37 at a lateral fold line 47. The compartment flap 31 has a first compartment bottom panel 49 foldably connected to the compartment panel 37 at the longitudinal fold line 23 that extends across the length of the blank 3. A first bottom end flap 51 is foldably connected to the bottom panel 49 at a longitudinal fold line 53. A first compartment side end flap 55, 57 is respectively foldably connected to one of the first and second side panels 35, 45 at the longitudinal fold line 23.

In the illustrated embodiment, a second (front) compartment flap 61 is foldably connected to the front panel 27 at a lateral fold line 63. The second compartment flap 61 is generally similar to the first compartment flap 31. The second compartment flap 61 comprises a first side panel 65, a compartment panel 67 foldably connected to the first side panel 65 at a fold line 69, and a second side panel 71 foldably connected to the compartment panel 67 at a lateral fold line 73. In one embodiment, the compartment panel 67 of the second compartment flap 61 has a generally U-shaped edge 75 that forms two upper retaining portions 67*a*, and a lower retaining portion 67*b* extending between the upper retaining portions. The second compartment flap 61 has a second compartment bottom panel 77 foldably connected to the compartment panel 67 at a longitudinal fold line 79. Second compartment side end flaps 81, 83 are respectively foldably connected to the first and second side panels 65, 71 at the longitudinal fold line 79. A second bottom end flap 85 is foldably connected to the bottom panel 77 at a longitudinal fold line 87.

In the illustrated embodiment an adhesive flap 91 extends between the first and second compartment flaps 31, 61 and is foldably connected to the second side panels 45, 71 at respective lateral fold lines 93, 95.

In one embodiment, the top flap includes four independent moveable portions 17*a*-17*d* that allow the top flap to fold over the top of the compartments 7, 9 and conform to the shape of products held in the compartments. The top flap 17 includes respective longitudinal fold lines 99, 101, 103 that separate the respective moveable portions 17*a*-17*d*. The longitudinal fold line 103 has two portions that extend from respective ends of a curved cut line 107. The cut line 107 forms an edge of a protrusion 108 in the moveable portion 17*d* of the top flap 17. The front panel 27 includes a curved cut 110 forming two moveable retention flaps 109, 111 in the front panel.

The blank 3 could have other features and aspects that are not shown by the drawings, or the features and aspects of the drawings that are illustrated could be modified without departing from the scope of the disclosure.

Figure 2:
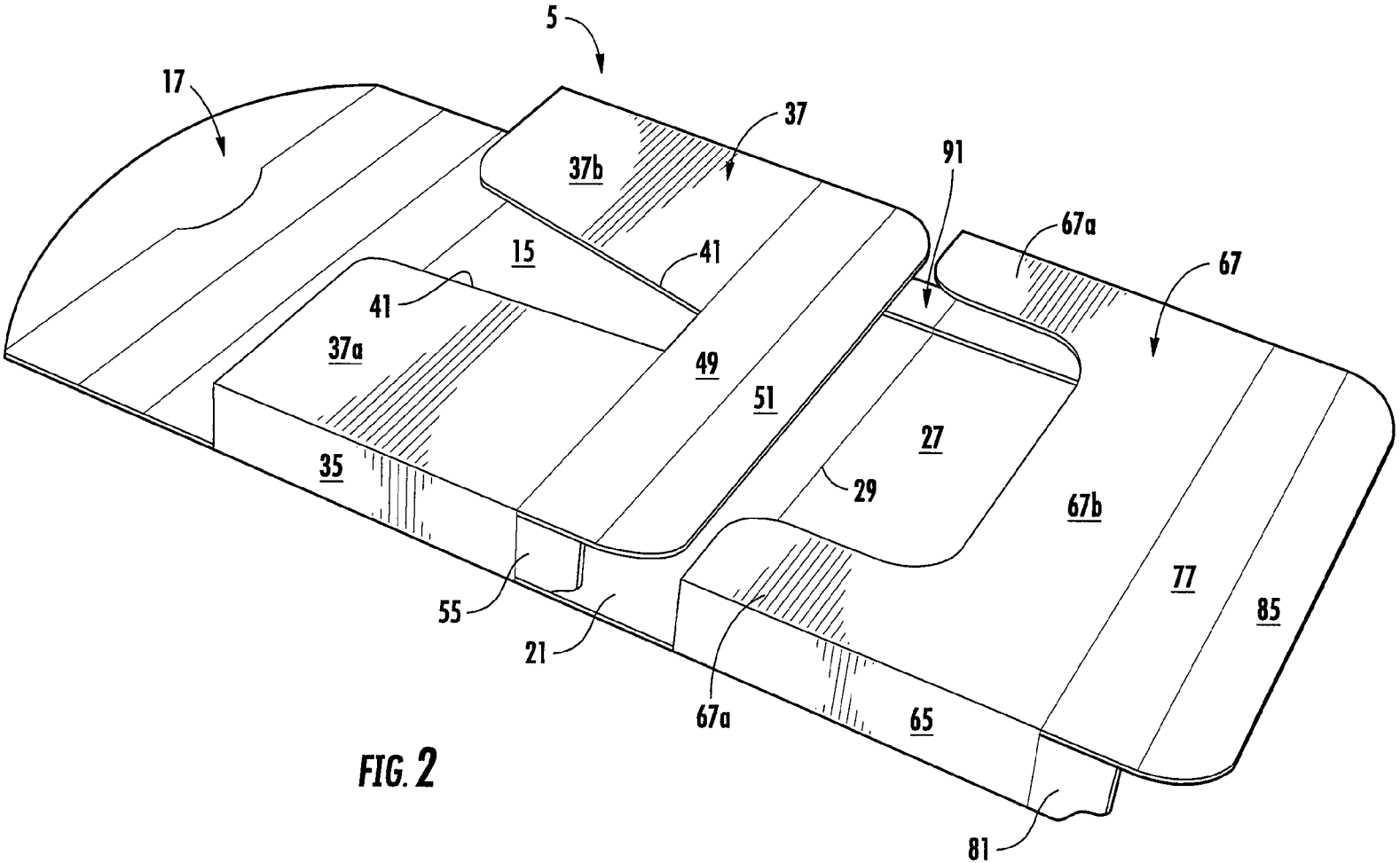
FIG. 2 is a perspective view of a partially-erected carton according to one embodiment of the disclosure.

An acceptable method for forming the carton 5 from the blank 3 will be described in the following, in accordance with one exemplary embodiment of the disclosure. In accordance with one exemplary embodiment, the blank 3 can be erected into the carton 5 by folding the first compartment flap 31 along fold lines 33, 39, 47, and 93 and folding the second compartment flap 61 along fold lines 63, 69, 73, and 95 to form the open ended first and second compartments 7, 9. The adhesive flap 91 is folded to be in face-to-face contact with the back panel 15, bottom panel 21, and front panel 27 and can be secured thereto by suitable adhesive (e.g., glue). The open-ended compartments 7, 9 shown in FIG. 2 can be closed at respective bottom ends of the compartments. The back compartment 9 is closed by folding the bottom panel 49 and side end flaps 55, 57 about fold line 23 to at least partially overlap the bottom panel and side end flaps. The bottom end flap 51 is folded to be in face-to-face contact with the back panel 15. The bottom end flap 51 can be secured to the back panel 15 by adhesive. In the illustrated embodiment, the bottom end of the front compartment 7 is closed in a similar manner. That is, the bottom panel 77, side end flaps 81, 83, and bottom end flap 85 close the bottom end of the front compartment 7.

Figure 4:
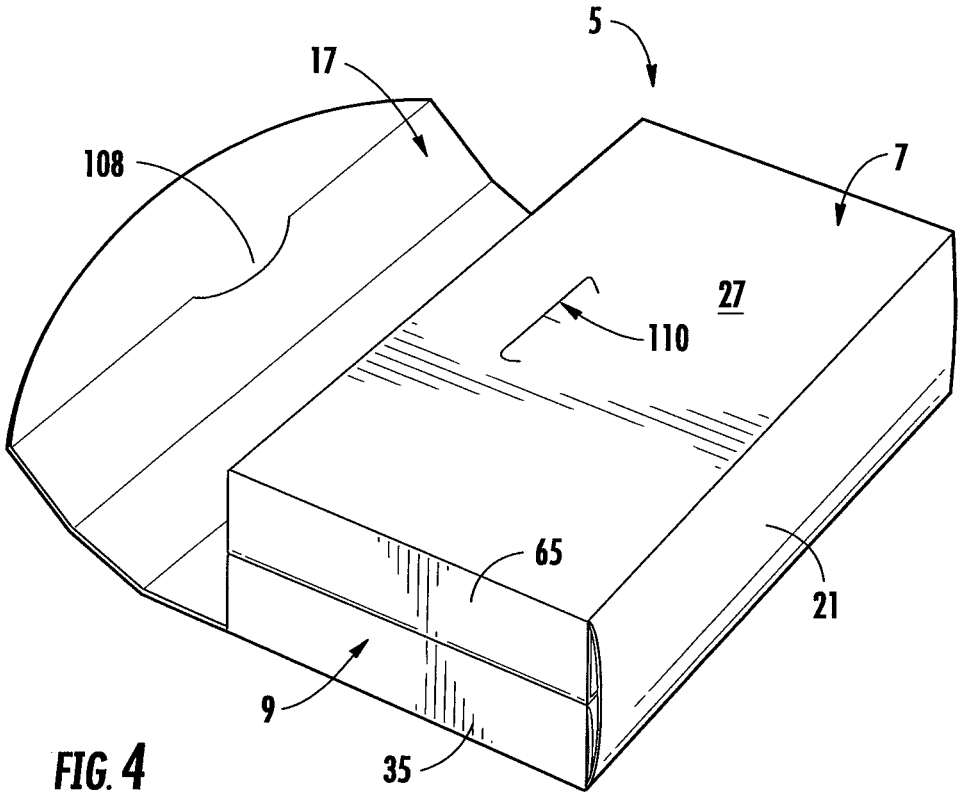
FIGS. 4-6 are perspective views of folding the carton of FIG. 3 into a closed configuration according to one embodiment of the disclosure.
Figure 5:
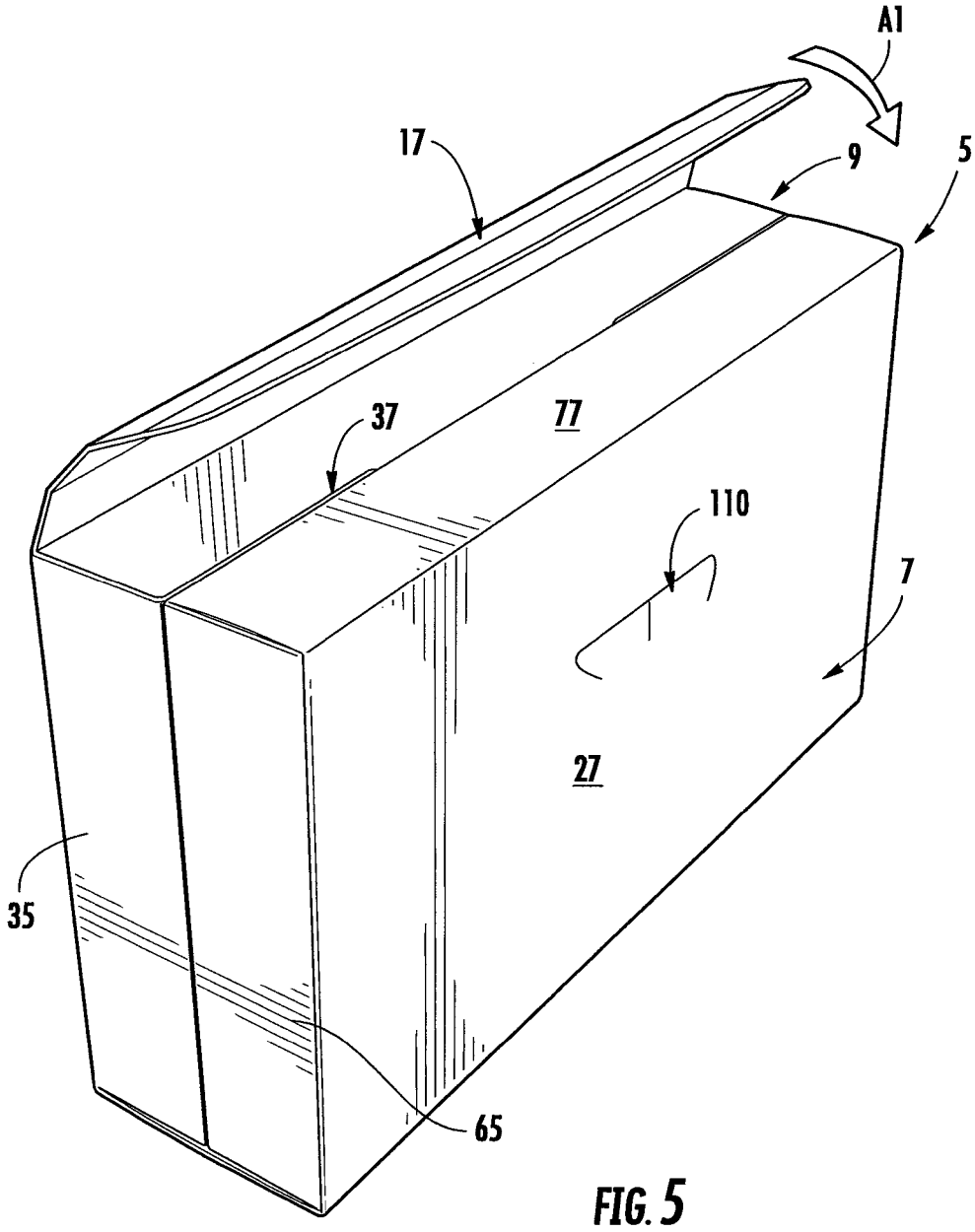

Once the front and back compartments 7, 9 are closed with the back panel 15, the bottom panel 21, and the front panel 27 generally in the same plane (FIG. 3), the carton 5 is in an open configuration 150 and can be loaded with one or more products in each compartment. After the products have been loaded into the carton, the front compartment 7 is folded about fold line 29 to be generally inverted and adjacent to the back compartment 9 (FIG. 4). That is, in one embodiment, the bottom panel 77 of the front compartment 7 is adjacent the top edge of the back compartment 9. In one embodiment, the compartment panel 67 of the front compartment 7 is placed into face-to-face contact with the compartment panel 31 of the back compartment 9 (FIGS. 4 and 5). As shown in FIGS. 5 and 6, the top flap 17 can be downwardly folded in the direction of arrow A1, to close the top of the back compartment 9 and to overlay the bottom panel 77 of the front compartment 7. The protrusion 108 can be received in an opening at the cut 110 that is formed by inwardly folding the flaps 109, 111 to lock the downwardly folded top flap 17 in the closed position (FIG. 6). The carton 5 is shown in a closed configuration 152 in FIG. 6.

The carton 5 can be opened by withdrawing the protrusion 108 from the cut 110 and upwardly folding the top flap 17 in the direction of arrow A2 (FIG. 6). Upon opening the top flap 17, the rear compartment 9 can be accessed. The front compartment 7 can be accessed by further unfolding the carton along fold line 23 to the open configuration 150 shown in FIG. 3. The carton 5 can be formed by other alternative forming steps, and the carton can be opened to access products within either the front compartment 7 or rear compartment 9 by other alternative opening steps without departing from the disclosure.

Figure 7:
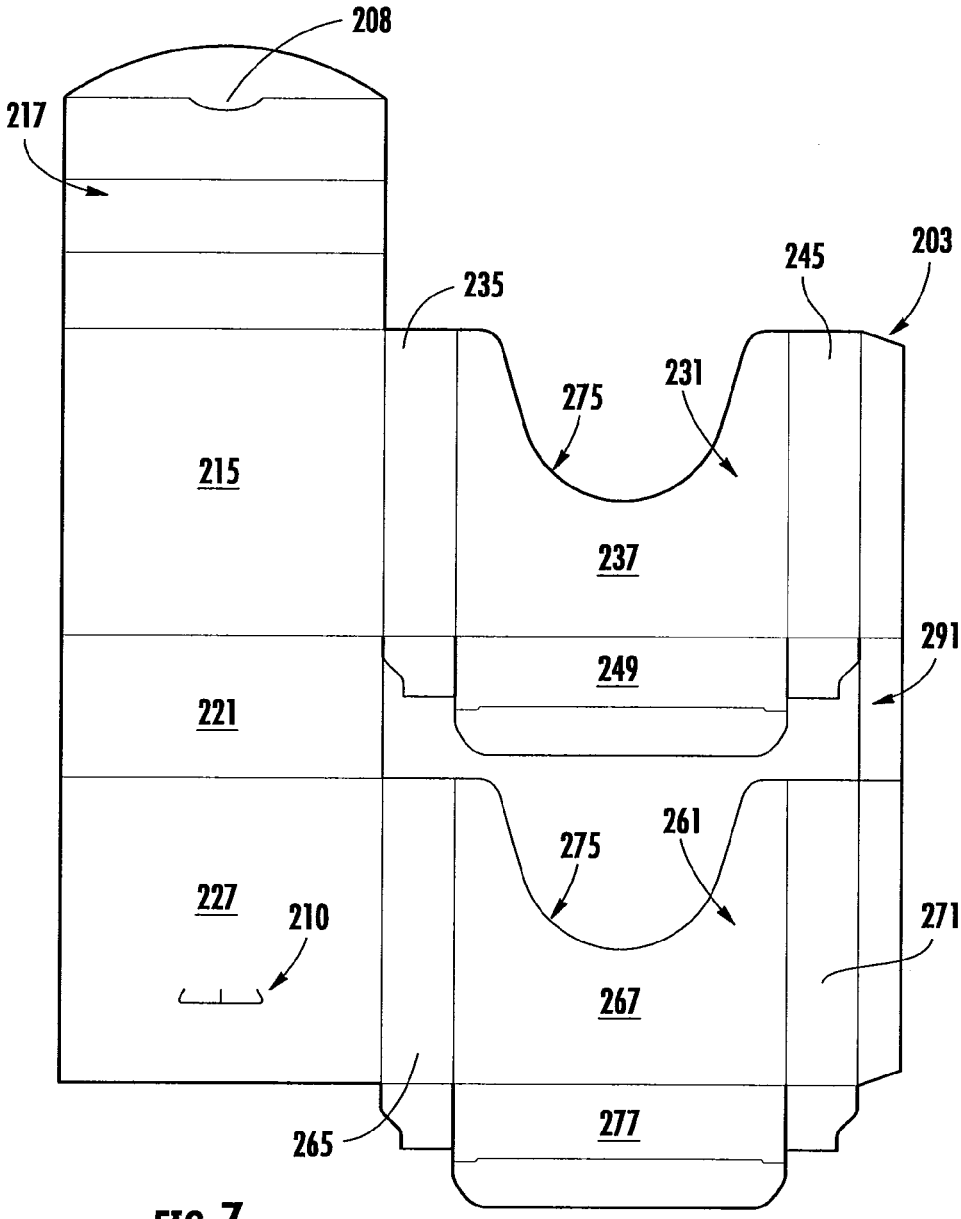
FIG. 7 is a plan view of an exterior of a carton blank for forming a carton according to a second embodiment of the disclosure.
Figure 8:
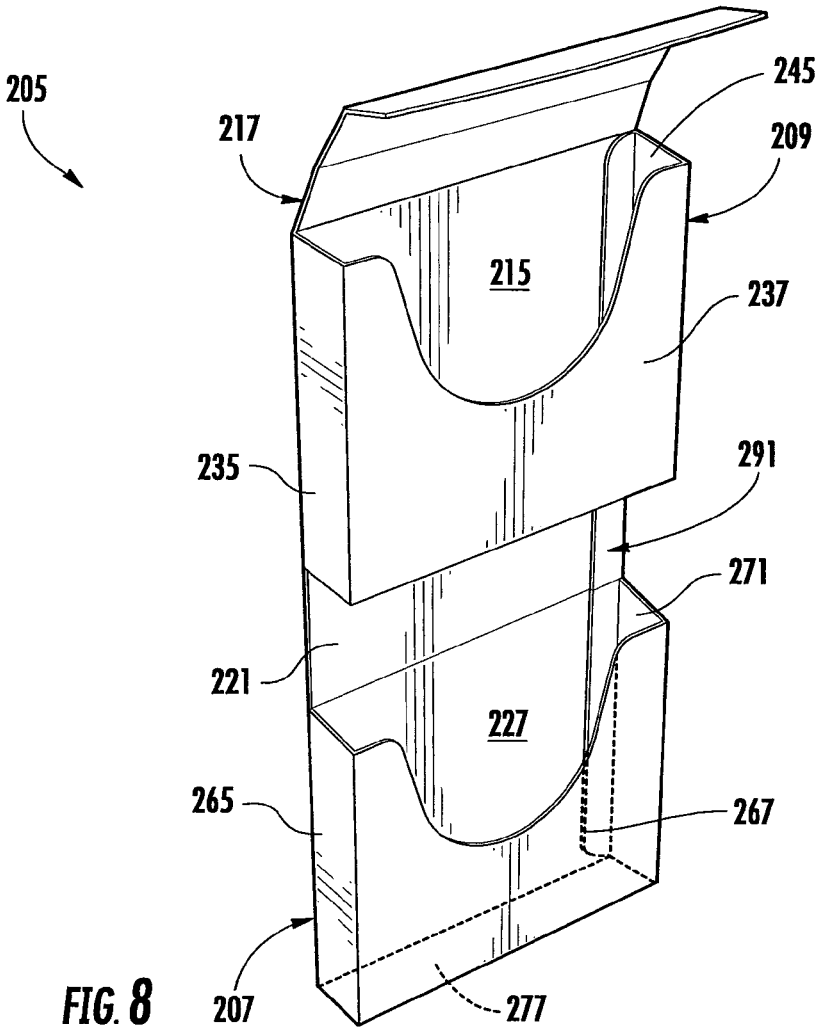
FIG. 8 is a perspective view of a carton in an open configuration according to the second embodiment of the disclosure.
Figure 9:
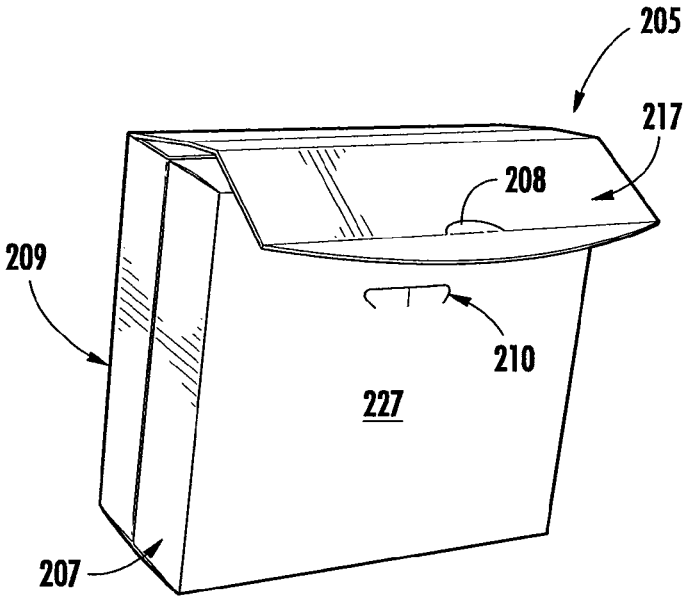
FIG. 9 is a perspective view of the carton of FIG. 8 in a closed configuration.

FIG. 7 illustrates a blank 203 for forming a carton 205 of a second embodiment of the disclosure having similar features as the first embodiment. Accordingly, similar or identical features of the embodiments are provided with like or identical reference numbers. The blank 203 can include a back panel 215, a top flap 217 and a bottom panel 221 respectively foldably connected to the back panel 215, and a front panel 227 foldably connected to the bottom panel 221. The front flap 227 can include a curved cut 210 for receiving a protrusion 208 in the top flap 217. A first compartment flap 231 includes a first side panel 235 foldably connected to the back panel 215 and a first compartment panel 237 foldably connected to the first side panel 235, a second side panel 245, and a first compartment bottom panel 249. A second compartment flap 261 includes a first side panel 265 foldably connected to the front panel 227 and a second compartment panel 267 foldably connected to the first side panel 265, a second side panel 271, and a second compartment bottom panel 277. An adhesive flap 291 can extend between the first and second compartment flaps 231, 261 and can be foldably connected to the second side panels 245, 271 at respective lateral fold lines. The blank 203 can be smaller in size than the blank 3 of the first embodiment and the compartment panels 237, 267 are identical to each other. Both of the compartment panels 237, 267 have U-shaped edges 275.

The blank 203 of FIG. 7 can be formed into the carton 205 in a generally similar manner as described above for the first embodiment. Alternatively, the blank 203 can be formed into the carton 205 by other steps and the blank 203 of the second embodiment could have other features.

Figure 10:
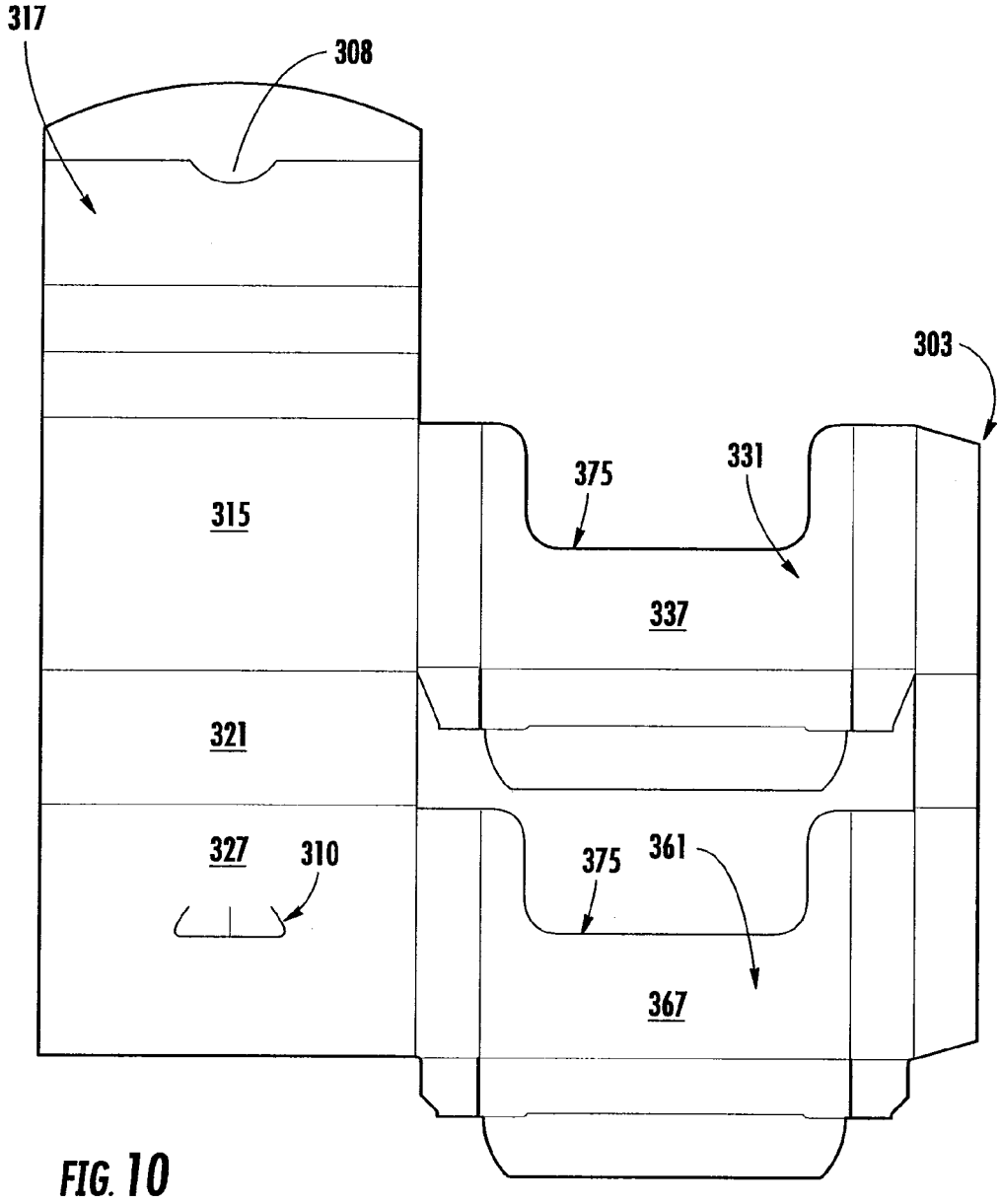
FIG. 10 is a plan view of an exterior of a carton blank for forming a carton according to a third embodiment of the disclosure.

FIG. 10 illustrates a blank 303 for forming a carton (not shown) of a third embodiment of the disclosure having similar features as the first and second embodiments. Accordingly, similar or identical features of the embodiments are provided with like or identical reference numbers. The blank 303 can include a back panel 315, a top flap 317 and a bottom panel 321 respectively foldably connected to the back panel 315, and a front panel 327 foldably connected to the bottom panel 321. The front flap 327 can include a curved cut 310 for receiving a protrusion 308 in the top flap 317. A first compartment flap 331 can be foldably connected to the back panel 315 and can include a first compartment panel 337 with a U-shaped edge 375. A second compartment flap 361 can be foldably connected to the front panel 327 and can include a second compartment panel 367 with a U-shaped edge 375. The blank 303 of FIG. 10 can be formed into the carton in a generally similar manner as described above for the first embodiment. Alternatively, the blank 303 can be formed into the carton by other steps and the blank 303 of the third embodiment could have other features.

Figure 11:
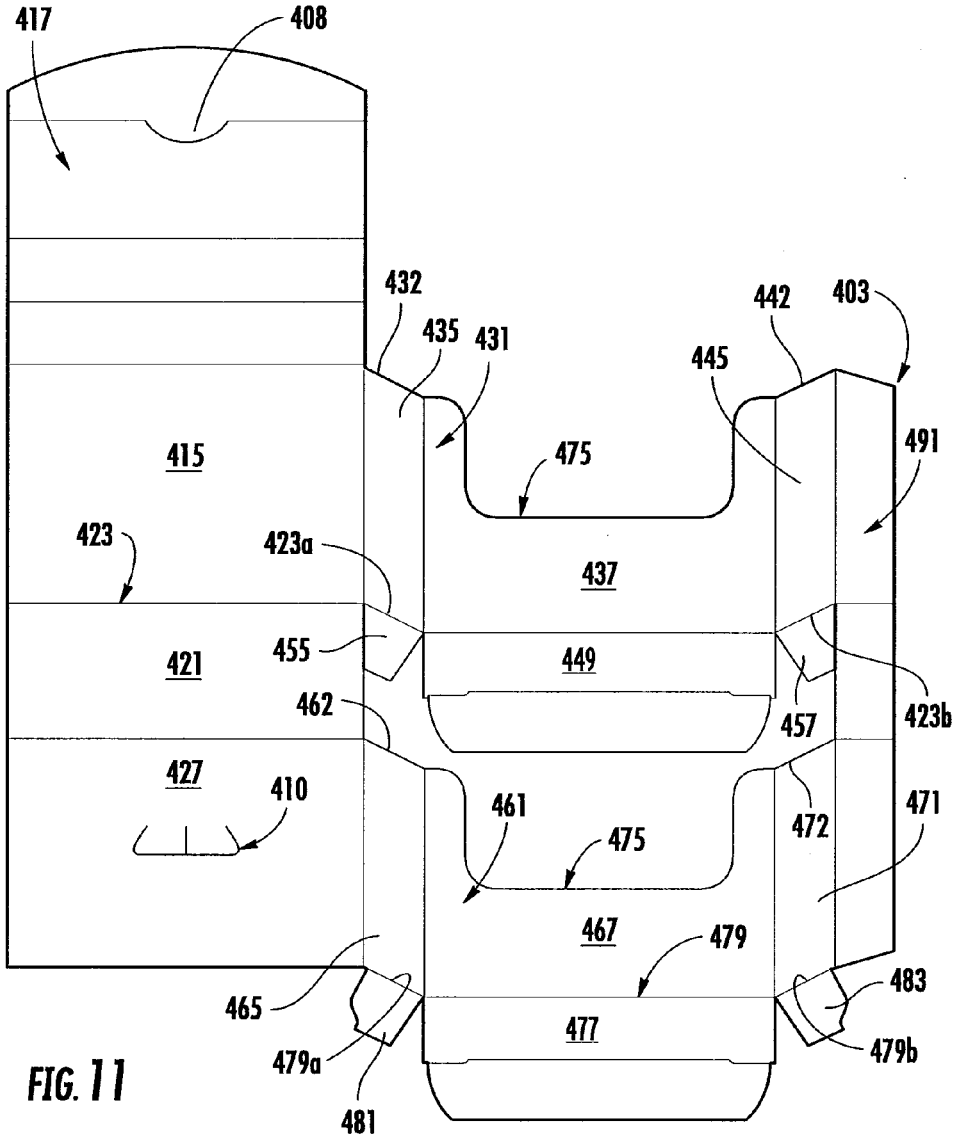
FIG. 11 is a plan view of an exterior of a carton blank for forming a carton according to a fourth embodiment of the disclosure.

FIG. 11 illustrates a blank 403 for forming a carton 405 (FIGS. 12-14) of a fourth embodiment of the disclosure having similar features as the first, second, and third embodiments. Accordingly, similar or identical features of the embodiments are provided with like or identical reference numbers. Generally the blank 403 can include a back panel 415, a top flap 417 and a bottom panel 421 respectively foldably connected to the back panel 415, and a front panel 427 foldably connected to the bottom panel 421. The front flap 427 can include a curved cut 410 for receiving a protrusion 408 in the top flap 417. A first compartment flap 431 includes a first side panel 435 foldably connected to the back panel 415 and a first compartment panel 437 foldably connected to the first side panel 435, a second side panel 445, and a first compartment bottom panel 449. A second compartment flap 461 includes a first side panel 465 foldably connected to the front panel 427 and a second compartment panel 467 foldably connected to the first side panel 465, a second side panel 471, and a second compartment bottom panel 477. An adhesive flap 491 can extend between the first and second compartment flaps 431, 461 and can be foldably connected to the second side panels 445, 471 at respective lateral fold lines.

The carton 405 differs from the carton 5 in that the carton of the fourth embodiment is an oblique rectangular prism having a top flap 417 and bottom panel 421 that are oblique relative to the front and back panels 415, 427. In the first embodiment, carton 5 is a rectangular prism with the top 17 and bottom 21 being perpendicular to the front and back panels 15, 17. In the embodiment of FIGS. 11-14, the fold line 423 of the blank 403 includes oblique portions 423*a*, 423*b* connecting the respective side end flaps 455, 457 to the respective side panels 435, 445, and the fold line 479 includes oblique portions 479*a*, 479*b* connecting the respective side end flaps 481, 483 to the respective side panels 465, 471. The side panels 435, 445 can include respective oblique top edges 432, 442 that are generally aligned with the respective oblique portions 479*a*, 479*b* of the fold line 479 in the closed configuration of the carton 5 (FIG. 13). Similarly, the side panels 465, 471 can include respective oblique top edges 462, 472 that are generally aligned with the respective oblique portions 423*a*, 423*b* of the fold line 423 in the closed configuration of the carton 5 (FIG. 13).

Figure 12:
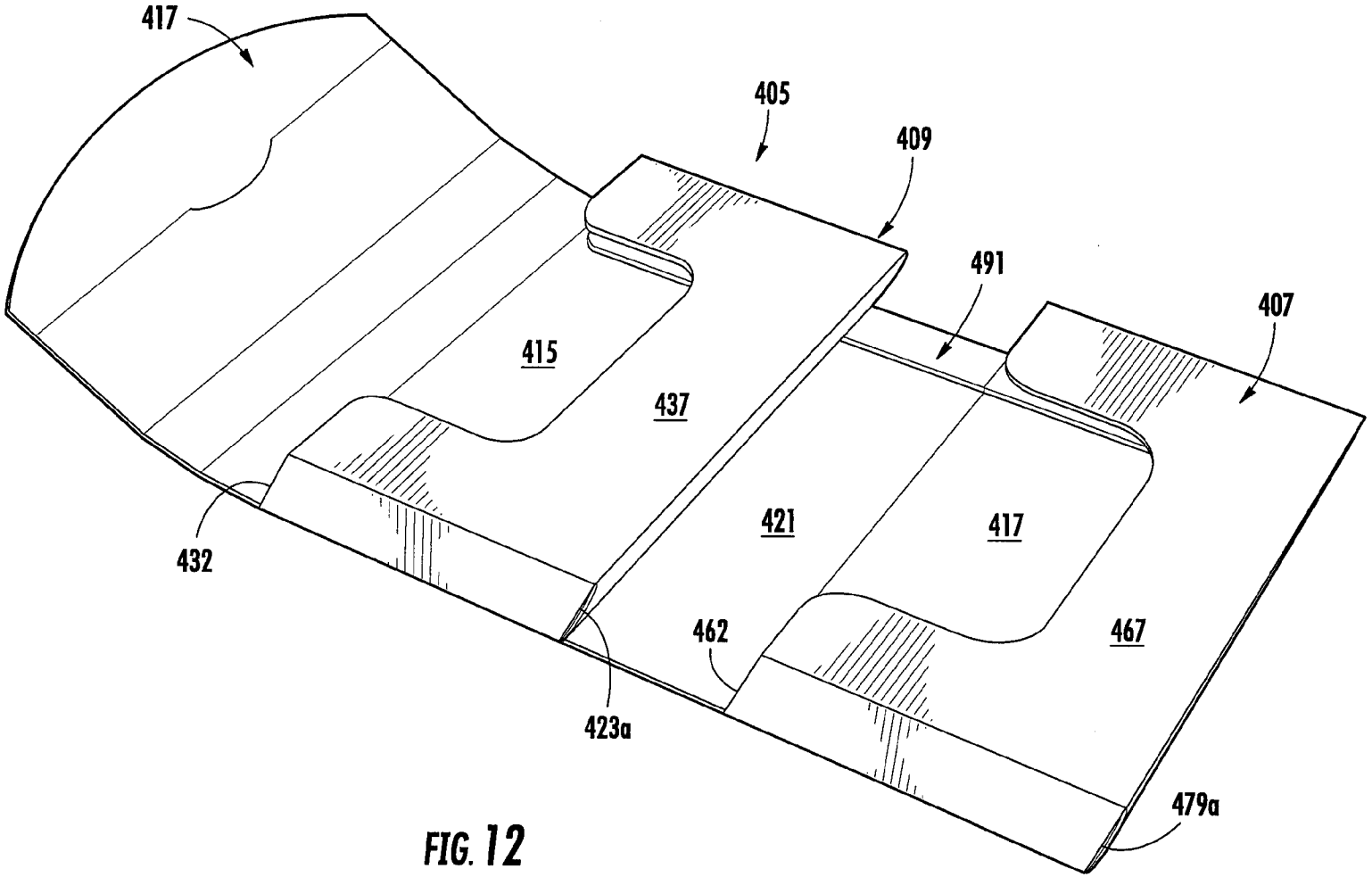
FIG. 12 is a perspective view of a carton in an open configuration according to the fourth embodiment of the disclosure.
Figure 13:
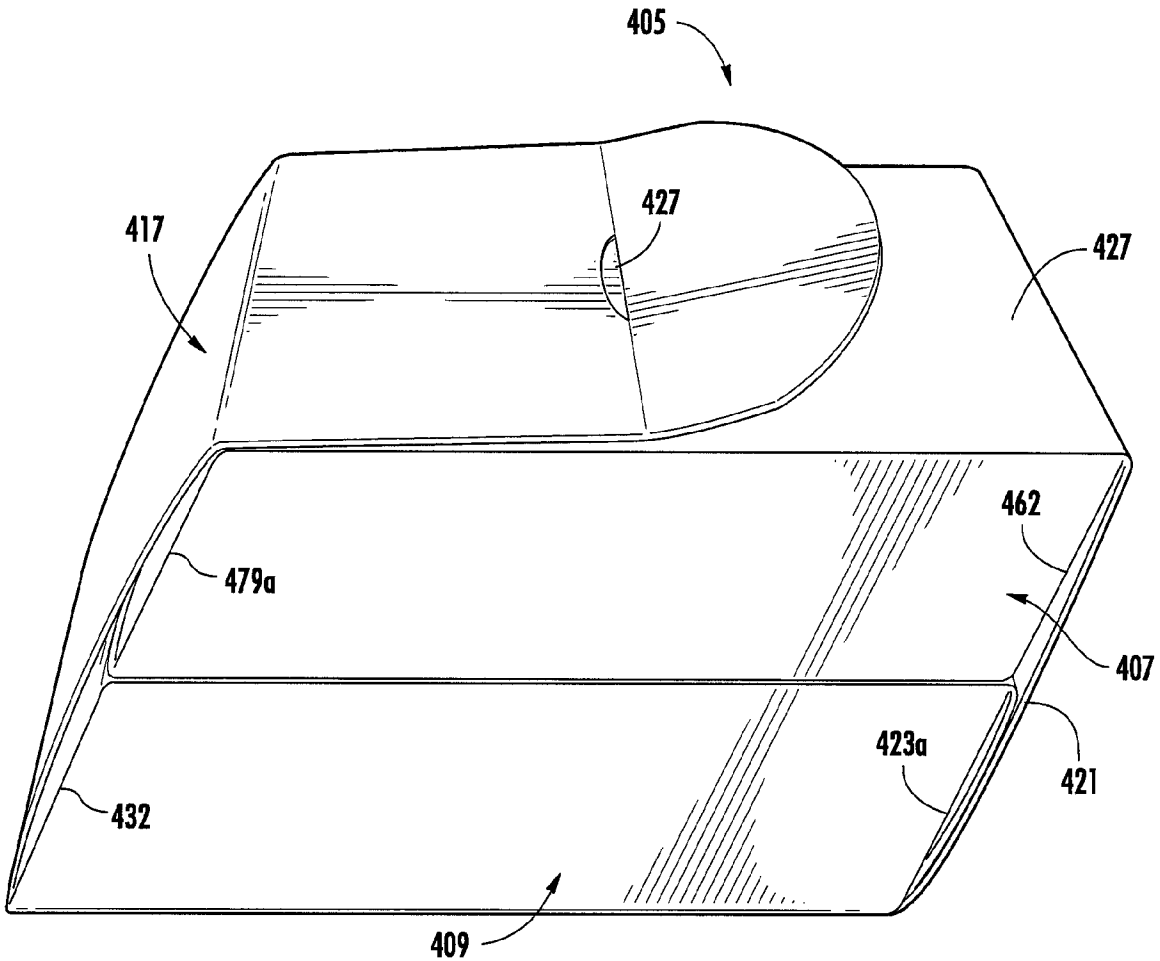
FIGS. 13 and 14 are perspective views of the carton of FIG. 12 in a closed configuration.
Figure 14:
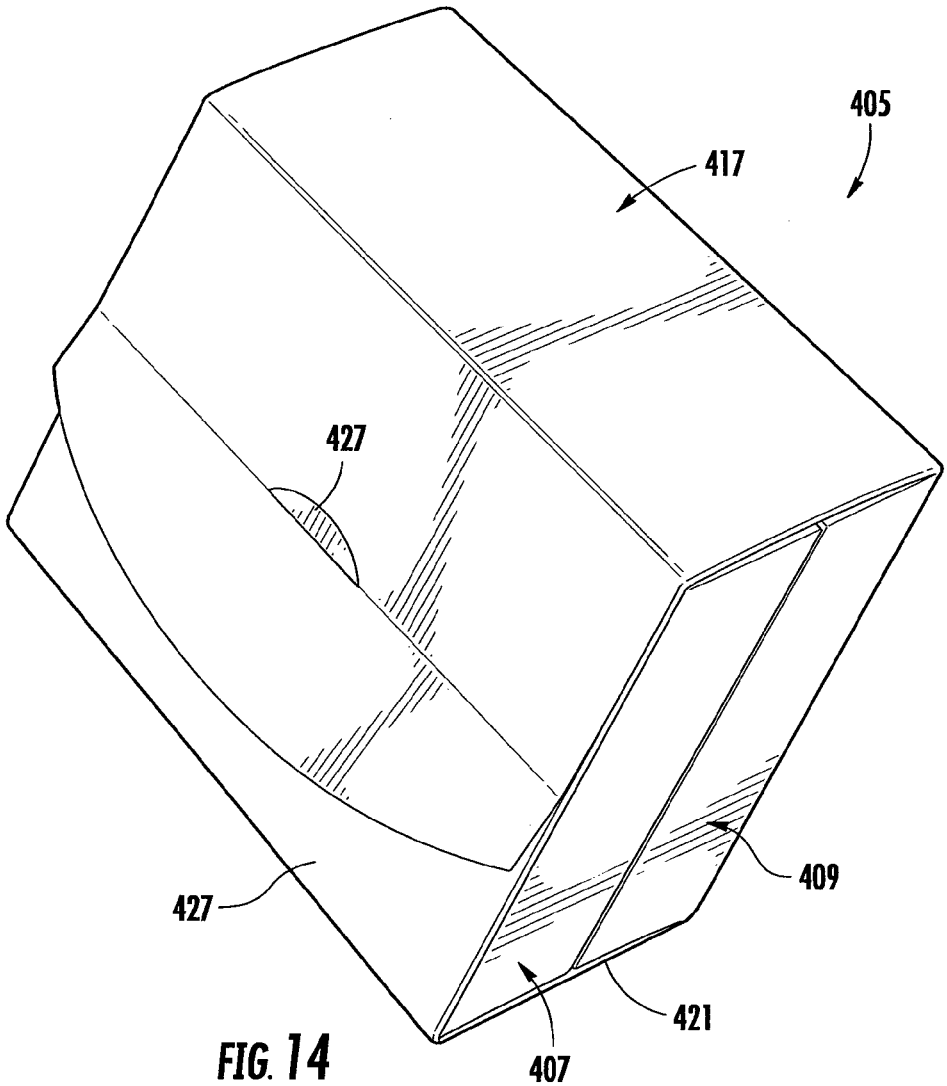

The blank 403 of FIG. 11 can be formed into the carton 405 in a generally similar manner as described above for the first embodiment and as shown in FIGS. 12-14. Alternatively, the blank 403 can be formed into the carton 405 by other steps and the blank 403 of the third embodiment could have other features. For example, one or both of the compartment panels 437, 467 can have oblique edges similar to the oblique edges 41 of the compartment panel 37 in the first embodiment instead of the U-shaped edges 475 shown in FIG. 11.

In general, the blank may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for containing at least one product, the carton comprising:

a back panel, a front panel, a bottom panel, and a top flap;

a first compartment foldably connected to the back panel;

a second compartment foldably connected to the front panel;

the first compartment comprises a first compartment panel and the back panel, the second compartment comprises a second compartment panel and the front panel; and wherein the top flap is operable to overlap the first and second compartments of the carton; and the first compartment further comprises a first side panel, a second side panel, and a first compartment bottom panel, each foldably connected to the first compartment panel, the first side panel is foldably connected to the back panel; the first compartment comprises a first bottom end flap foldably connected to the first compartment bottom panel, the first bottom end flap has a free edge that is free from foldable connection to the second compartment.

2. The carton of claim 1, wherein the first compartment and the second compartment are positioned in a side-by-side, inverted relationship with a top of the first compartment being adjacent a bottom of the second compartment.

3. The carton of claim 1, wherein the first bottom end flap and the first compartment bottom panel at least partially close the bottom of the first compartment.

4. The carton of claim 3, wherein the second compartment further comprises a third side panel, a fourth side panel, and a second compartment bottom panel, each foldably connected to the second compartment panel, the third side panel is foldably connected to the front panel.

5. The carton of claim 4, wherein the second compartment comprises a second bottom end flap foldably connected to the second compartment bottom panel, the second bottom end flap and the second compartment bottom panel at least partially close the bottom of the second compartment.

6. The carton of claim 5, further comprising an adhesive flap foldably connected to each of the second and fourth side panels, wherein the adhesive flap is at least partially in face-to-face contact with at least the back panel, the bottom panel, and the front panel.

7. The carton of claim 6, wherein the first compartment panel is at least partially in face-to-face contact with the second compartment panel, the first compartment bottom panel is in face-to-face contact with at least a portion of the bottom panel, and the second compartment bottom panel is in face-to-face contact with at least a portion of the top flap.

8. The carton of claim 6, wherein the carton is in an open configuration with the back panel, bottom panel, and front panel generally aligned in generally the same plane for allowing access to an at least partially open first top of the first compartment and an at least partially open second top of the second compartment.

9. The carton of claim 5, wherein the first compartment bottom panel and the second compartment bottom panel each extends generally perpendicular to the respective back and front panels.

10. The carton of claim 5, wherein the first compartment bottom panel extends obliquely from the first compartment panel to the back panel, and the second compartment bottom panel extends obliquely from the second compartment panel to the front panel.

11. The carton of claim 5, wherein each of the first, second, third, and fourth side panels comprises a respective first, second, third, and fourth oblique top edge.

12. The carton of claim 11, wherein the first compartment comprises at least one first compartment side end flap foldably connected to at least one of the first and second side panels at least one first oblique fold line and the second compartment comprises at least one second compartment side end flap foldably connected to at least one of the third and fourth side panels at least one second oblique fold line, the first compartment bottom panel extending obliquely from the first compartment panel to the back panel generally parallel to the at least one first oblique fold line, and the second compartment bottom panel extending obliquely from the second compartment panel to the front panel generally parallel to the at least one second oblique fold line.

13. The carton of claim 12, wherein at least one of the first and second top edges is generally aligned with the at least one second oblique fold line, and at least one of the third and fourth top edges is generally aligned with the at least one first oblique fold line.

14. The carton of claim 5, wherein the second bottom end flap has a free edge that is free from foldable connection to the first compartment.

15. The carton of claim 1, wherein the top flap is foldably connected to at least one of the front panel and the back panel, the top flap comprising at least two moveable portions with a longitudinal fold line extending at least partially between the at least two moveable portions.

16. The carton of claim 15, wherein the top flap comprises a cut line extending in the top flap and at least partially defining a protrusion positioned to engage at least one cut in the front panel.

17. The carton of claim 16, wherein the at least one cut in the front panel at least partially defines at least one moveable retention flap in the front panel.

18. The carton of claim 1, wherein each of the first and second compartments comprises an at least partially open compartment top adjacent a respective edge of the first and second compartment panels, and at least one of the first and second compartment panels comprises at least one retaining portion at least partially defined by a respective edge and extending from the at least partially open top of the respective first and second compartment, the retaining portion being for retaining the at least one product in the carton.

19. The carton of claim 18, wherein the respective edge is generally U-shaped and the at least one retaining portion comprises two upper retaining portions and a lower retaining portion extending between the upper retaining portions.

20. The carton of claim 1, wherein each of the first and second compartments comprises an at least partially open compartment top, the first compartment panel comprises at least one first compartment retaining portion at least partially defined by at least one oblique edge extending from the at least partially open top of the first compartment, and the second compartment panel comprises at least one second compartment retaining portion at least partially defined by at least one U-shaped edge extending from the at least partially open top of the second compartment.

21. The carton of claim 1, wherein the top flap is connected to at least the back panel at a longitudinal fold line, the top flap comprising a protrusion at least partially defined by a cut line in the top flap, the protrusion being received in a cut extending in the front panel.

22. The carton of claim 1 wherein the bottom panel is foldably connected to the back panel and the front panel.

23. A blank for forming a carton for containing at least one product, the blank comprising:

a back panel, a front panel, a bottom panel, and a top flap;

a first compartment flap foldably connected to the back panel; and a second compartment flap foldably connected to the front panel; and the first compartment flap comprises a first compartment panel, and the second compartment flap comprises a second compartment panel;

wherein the top flap is for overlapping a first compartment formed from the first compartment flap and a second compartment formed from the second compartment flap when the blank is formed into the carton; and the first compartment flap further comprises a first side panel, a second side panel, a first compartment bottom panel, each foldably connected to the first compartment panel, the first side panel is foldably connected to the back panel; and the first compartment flap comprises a first bottom end flap foldably connected to the first compartment bottom panel, the first bottom end flap has a free edge that is free from foldable connection to the second compartment flap.

24. The blank of claim 23, wherein the first compartment and the second compartment are for being positioned in a side-by-side, inverted relationship with a top of the first compartment being adjacent a bottom of the second compartment in the carton formed from the blank.

25. The blank of claim 23, wherein the first bottom end flap and the first compartment bottom panel being for at least partially closing the bottom of the first compartment formed from the first compartment flap.

26. The blank of claim 25, wherein the second compartment flap further comprises a third side panel, a fourth side panel, and a second compartment bottom panel, each foldably connected to the second compartment panel, the third side panel is foldably connected to the front panel.

27. The blank of claim 26, wherein the second compartment flap comprises a second bottom end flap foldably connected to the second compartment bottom panel, the second bottom end flap and the second compartment bottom panel being for at least partially closing the bottom of the second compartment formed from the second compartment flap.

28. The blank of claim 27, further comprising an adhesive flap foldably connected to each of the second and fourth side panels, wherein the adhesive flap is for being positioned at least partially in face-to-face contact with at least the back panel, the bottom panel, and the front panel.

29. The blank of claim 27, wherein each of the first, second, third, and fourth side panels comprises a respective first, second, third, and fourth oblique top edge.

30. The blank of claim 29, wherein the first compartment flap comprises a first side end flap foldably connected to the first side panel at a first oblique fold line and a second side end flap foldably connected to the second side panel at a second oblique fold line, and the second compartment flap comprises a third side end flap foldably connected to the third side panel at a third oblique fold line and a fourth side end flap foldably connected to the fourth side panels at a fourth oblique fold line, wherein each of the first, second, third, and fourth oblique fold lines is generally parallel with a respective first, second, third, and fourth oblique top edge.

31. The blank of claim 27, wherein the second bottom end flap has a free edge that is free from foldable connection to the first compartment flap.

32. The blank of claim 23, wherein the top flap is foldably connected to at least one of the front panel and the back panel, the top flap comprising at least two moveable portions with a longitudinal fold line extending at least partially between the at least two moveable portions.

33. The blank of claim 32, wherein the top flap comprises a cut line extending in the top flap and at least partially defining a protrusion positioned to engage at least one cut in the front panel.

34. The blank of claim 33, wherein the at least one cut in the front panel at least partially defines at least one moveable retention flap in the front panel.

35. The blank of claim 23, wherein each of the first and second compartment panels comprises an upper edge, and at least one of the first and second compartment panels comprises at least one retaining portion at least partially defined by a respective edge extending from the respective upper edge of the respective first and second compartment panels, the retaining portion being for retaining the at least one product in the carton formed from the blank.

36. The blank of claim 35, wherein the respective edge is generally U-shaped and the at least one retaining portion comprises two upper retaining portions and a lower retaining portion extending between the upper retaining portions.

37. The blank of claim 23, wherein each of the first and second compartment panels comprises a respective first upper edge and second upper edge, the first compartment panel comprises at least one first compartment retaining portion at least partially defined by at least one oblique edge extending from the first upper edge of the first compartment panel, and the second compartment panel comprises at least one second compartment retaining portion at least partially defined by at least one U-shaped edge extending from the second upper edge of the second compartment panel.

38. The blank of claim 23, wherein the top flap is connected to at least the back panel at a longitudinal fold line, the top flap comprising a protrusion at least partially defined by a cut line in the top flap, the protrusion being positioned to be received in a cut extending in the front panel.

39. The blank of claim 23 wherein the bottom panel is foldably connected to the back panel and the front panel.

40. A method for forming a carton for containing at least one product, the method comprising:

obtaining a blank comprising a back panel, a front panel, a bottom panel, a top flap, a first compartment flap foldably connected to the back panel, and a second compartment flap foldably connected to the front panel, the first compartment flap comprising a first side panel, a second side panel, and a first compartment bottom panel, each foldably connected to the first compartment flap, the first side panel is foldably connected to the back panel, and the first compartment flap comprises a first bottom end flap foldably connected to the first compartment bottom panel, the first bottom end flap has a free edge that is free from foldable connection to the second compartment flap;

forming a first compartment by folding the first compartment flap with respect to the back panel;

forming a second compartment by folding the second compartment flap with respect to the front panel; and at least partially closing the carton by folding the top flap to at least partially overlap the first and second compartments.

41. The method of claim 40, wherein the at least partially closing the carton further comprises positioning the first compartment and the second compartment in a side-by-side, inverted relationship with a top of the first compartment being adjacent a bottom of the second compartment.

42. The method of claim 40, wherein the first compartment flap comprises a first compartment panel and the forming the first compartment comprises folding the first compartment flap so the first compartment panel is disposed generally opposite to the back panel, and wherein the second compartment flap comprises a second compartment panel and the forming the second compartment comprises folding the second compartment flap so the second compartment panel is disposed generally opposite to the front panel.

43. The method of claim 42, wherein the blank further comprises an adhesive flap foldably connected to each of the first and second compartment flaps, and wherein the forming the first and second compartments further comprises positioning the adhesive flap at least partially in face-to-face contact with at least the back panel and the front panel.

44. The method of claim 42, wherein each of the first and second compartments comprises an at least partially open compartment top adjacent a respective edge of the first and second compartment panels, and at least one of the first and second compartment panels comprises at least one retaining portion at least partially defined by a respective edge and extending from the at least partially open top of the respective first and second compartment, the retaining portion being for retaining the at least one product in the carton.

45. The method of claim 44, wherein the respective edge is generally U-shaped and the at least one retaining portion comprises two upper retaining portions and a lower retaining portion extending between the upper retaining portions.

46. The method of claim 40, wherein the at least partially closing the carton further comprises positioning the bottom panel and the top flap to extend generally obliquely with respect to the front panel and the rear panel.

47. The method of claim 40, wherein the top flap is connected to at least the back panel and comprises a protrusion at least partially defined by a cut line in the top flap, and wherein the at least partially closing the carton further comprises inserting the protrusion into a cut in the front panel.

* * * * *